United States Patent [19]

Wallner

[11] Patent Number: 4,942,647

[45] Date of Patent: Jul. 24, 1990

[54] TENSIONING BUCKLE

[76] Inventor: Peter H. Wallner, 114 Vasey Cres, Campbell A.C.T 2601, Australia

[21] Appl. No.: 243,515

[22] Filed: Sep. 12, 1988

[30] Foreign Application Priority Data

Sep. 25, 1987 [AU] Australia ..... PI4597

[51] Int. Cl.[5] ..... A44B 11/10

[52] U.S. Cl. ..... 24/170; 24/191

[58] Field of Search ..... 24/170, 191, 68 CD, 24/69 R, 69 CT, 71.2, 585

[56] References Cited

U.S. PATENT DOCUMENTS

| | | | |
|---|---|---|---|
| 353,842 | 12/1886 | Bristol | 24/170 |
| 631,669 | 8/1899 | Rankin | 24/170 |
| 896,359 | 8/1908 | Buchanan | 24/191 |
| 913,469 | 2/1909 | Cleaveland | 24/170 |
| 1,962,285 | 6/1934 | Robinson | 24/191 |
| 2,901,794 | 9/1959 | Prete, Jr. | 24/170 |
| 3,231,307 | 1/1966 | Smith | 24/170 |
| 3,413,691 | 12/1968 | Elsner | 24/170 |
| 3,686,715 | 8/1972 | Brodnicki | 24/170 |
| 4,685,315 | 8/1987 | Comolli | 24/170 |

FOREIGN PATENT DOCUMENTS

| | | | |
|---|---|---|---|
| 0487272 | 12/1929 | Fed. Rep. of Germany | 24/191 |
| 1333646 | 6/1963 | France | 24/191 |

*Primary Examiner*—Victor N. Sakran

[57] ABSTRACT

A buckle fitting that can tension with leverage, lengths of belt or webbing. The buckle will lock the belt at any point along its length until freed by a quick release mechanism. The buckle consists of two u-sections pivotably connected at one end to allow a hinge action of the longer upper section about the lower section. A spring loaded cam with a limited movement, rocks away from the surface of the lower section to allow belt to move forward and moves closer to the surface of the lower section to prevent belt moving backwards. A cylindrical roller locates across the lower section between the cam and the hinged join. A slot in the upper section allows belt to pass through when the upper section is closed over the lower section. When the upper section is levered in an arc about the lower section the relative aspect of the slot alters enabling belt to be caught and pulled further through the cam in the lower section. Repeating this action further advances the belt through the buckle. The locking cam can be overriden manually in order to release the tensioned belt.

4 Claims, 2 Drawing Sheets

TENSIONING BUCKLE

BACKGROUND OF THE INVENTION

This invention relates to buckle type fittings capable of locking belt in load bearing situations.

In many situations there is a need to be able to achieve a high degree of tension in a belt, maintain the tension securely and quickly release it when desired.

While existing buckle fittings may be capable of some or all of these functions, they usually involve complicated construction and fallible ratchet and spool mechanisms. The need is recognised to produce a tensioning buckle of lightweight, slim design with a simple construction and operation as well as being capable of the mentioned functions.

BRIEF SUMMARY OF THE INVENTION

An object of the present invention is to provide a simple buckle fitting that can apply, maintain and instantly release tension in lengths of belt.

Another object is to provide a buckle that is in principle applicable to all sizes of belt.

Another object is to provide a buckle fitting that can effectively lock at any point along the length of an unperforated belt without distorting or winding the excess belt onto a spool mechanism.

Another object is to provide a buckle fitting as described, of simple construction and operation, light weight, thin dimension and having few parts.

In general summary the buckle includes two u-sectioned bodies pivotably connected at one end. The lower body houses a spring loaded cam which allows belt to advance through the buckle but prevents the belt slipping back. A roller also located in the lower body facilitates the belt movement and reduces friction. The longer upper body contains a tongue and slot which, when levered about the pivot attachment to the lower body will grip and pull belt further through the cam. Repeating this lever action advances and maintains tension in the belt until released via the cam mechanism.

DESCRIPTION OF THE PREFERRED EMBODIMENT

Figure 2:
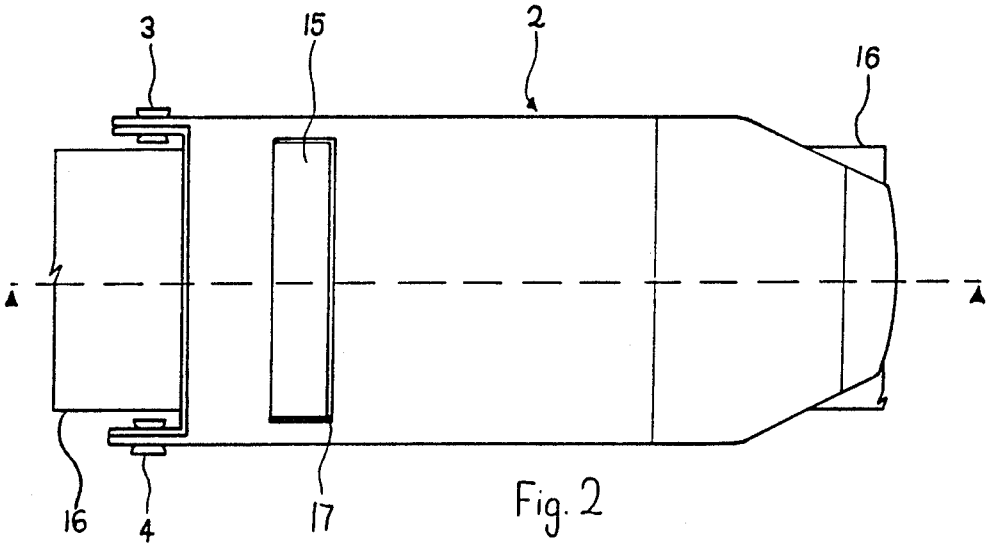
FIG. 2 is a plan view of the invention.
Figure 1:
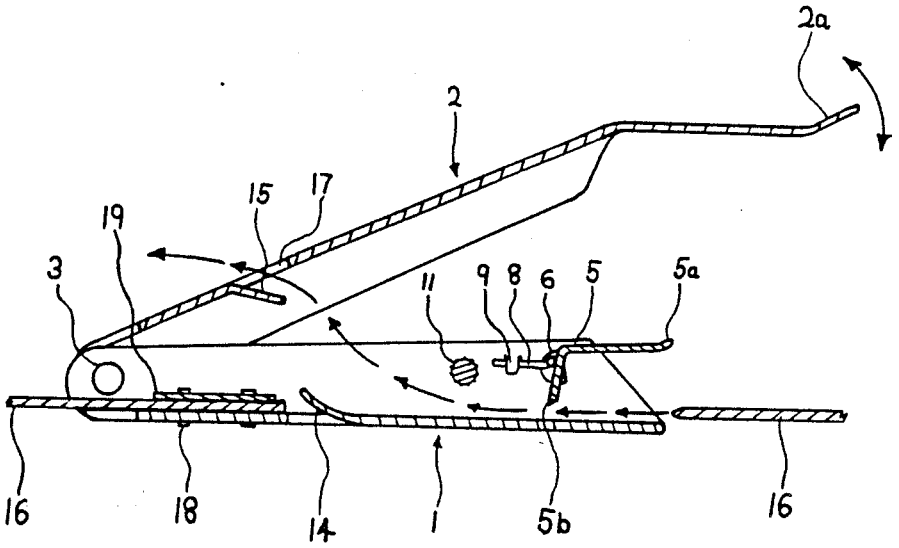
FIG. 1 is a sectioned elevation of one embodiment of the invention.
Figure 3:
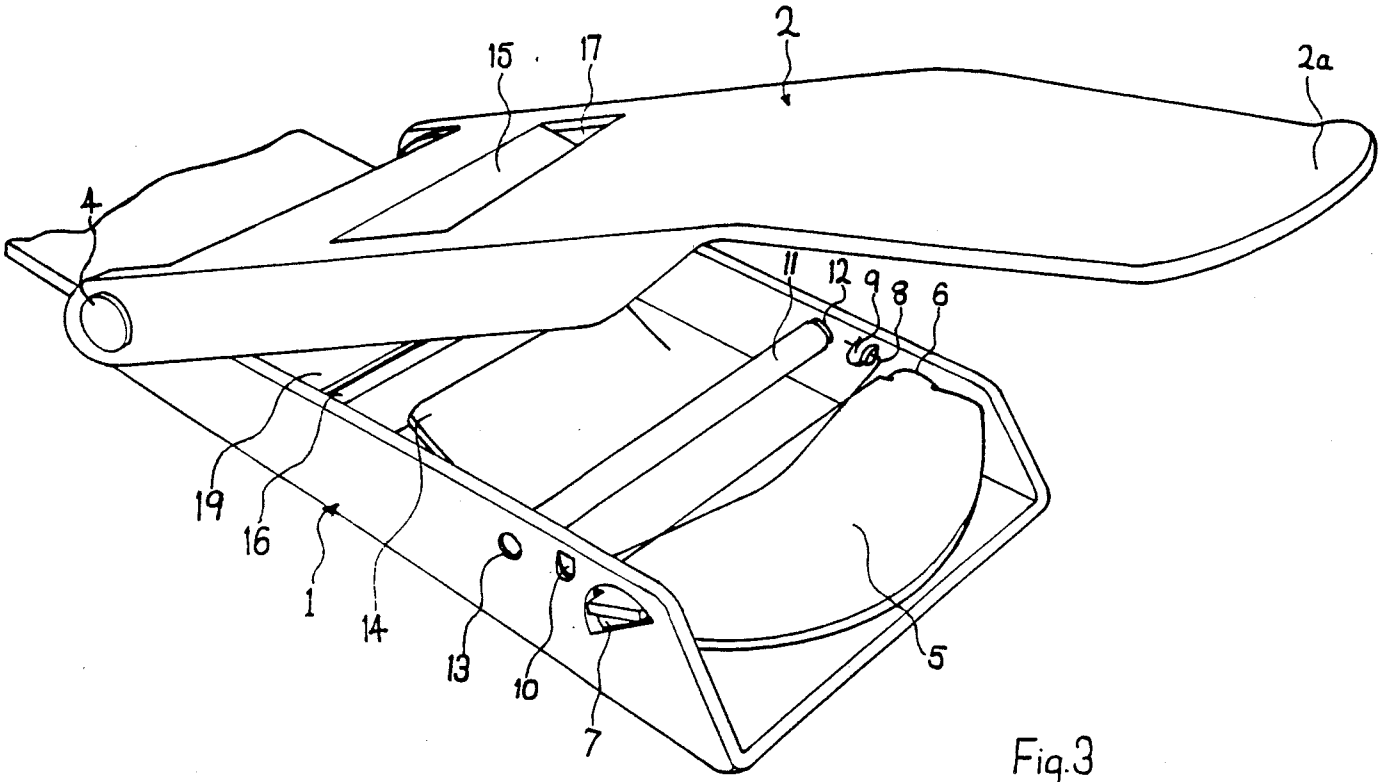
FIG. 3 is a perspective illustration of the invention.

The drawings depict a tensioning buckle comprising a u-sectioned lower body 1, being pivotably connected at hinge pivots 3,4 to a similarly sectioned slightly wider, upper body 2. Upper body 2 may thus close over lower body 1 and pivot freely, up to 180 degrees, about lower body 1 at hinge pivots 3,4.

Protruding edges of cam 5 locate laterally in lower body 1 by seating in holes 6,7. Holes 6,7 are suitably shaped to allow a limited turning action of cam 5 about a line through holes 6,7. The turning action of cam 5 effectively raises and lowers the belt contact edge **5*b* relative to the surface of lower body 1 while the opposite relative movement occurs at finger contact end 5*a*. Means to apply pressure tending cam belt contact edge 5*b* towards lower body 1 is achieved by torsion spring 8. A medial portion of torsion spring 8 contacts cam 5 while the ends locate in tabs 9,10 in lower body 1**.

A cylindrical roller 11 locates laterally in lower body 1 between cam 5 and hinge pivots 3,4. Round holes 12,13 locate roller 11 in lower body 1 so as to allow turning and enable belt 16 to pass between.

The surface of lower body 1, between the roller 11 and and hinge pivots 3,4 protrudes upwards to form a tongue 14, which correlates to a similar tongue 15 projecting down from upper body 2. When upper body 2 is positioned to overlap lower body 1, tongues 14 and 15 converge to provide means to direct belt 16 through a slot 17 in upper body 2.

Means to attach one end of belt 16 to lower body 1 is provided by studs 18 passing through holes in plate 19, belt 16 and lower body 1.

The end of upper body 2 extending furthest from hinge pivots 3,4 is upturned at grip **2*a* to facilitate manual lifting and levering of upper body 2 about lower body 1**.

In the use and operation of the invention; belt 16 is passed around objects to be restrained and the free end of belt 16 is passed along the upper surface of lower body 1, between cam 5 and roller 11. With upper body 2 closed over lower body 1, belt 16 is guided by tongue 14 onto tongue 15 and through slot 17. Upper body 2 is then manually levered about hinge pivots 3,4 on lower body 1. As the aspect of slot 17 alters, belt 16 is gripped and pulled further along the surface of lower body 1, between the roller 11 and cam belt contact edge **5*b*. After the lever arc of upper body 2 is completed it is returned to seat over lower body 1, while cam 5 prevents belt 16 as belt contact edge 5*b* locks into belt 16 and against lower body 1. Repeating the lever action further advances belt 16 through the buckle until the desired tension is achieved. Upper body 2 is then returned to cover lower body 1 thus preventing accidental release of the cam 5. To release belt 16, upper body 2 is levered about lower body 1 allowing recess to cam finger contact end 5*a*. Depressing cam 5 at finger contact end 5*a* raises the belt contact edge 5*b* from the surface of the belt 16** thus releasing it.

The above description details an embodiment of the invention thats true spirit and scope are embraced in the following claims;

What is claimed is:

1. A buckle for tensioning belt including the combination of: overlapping U-sectioned upper and lower bodies being pivotably connected and manually leverable about each other; said lower body laterally housing, in proximal order to said pivotably connected end, means to permanently attach a belt end, an upwardly protruding tongue to direct belt, a cylindrical roller, a torsional spring, a manually operated cam contacting said torsional spring; said cam allowing belt to feed between it and said lower body towards said pivotably connected end and preventing belt slipping away from said pivotably connected end, said cam having limited movement by locating in non circular holes in sides of said lower body; said upper body laterally housing; a downwards protruding tongue corresponding to said tongue in said lower body when buckle is in a closed position, a slot adjacent to said tongue, said slot and tongue edges being oriented to allow belt to pass through said slot when buckle is in a closed position and grip belt as said upper body is levered about said lower body.

2. A buckle as in claim 1 with a slot adjacent to a tongue protruding downwards from a pivotably connected upper body at an angle such that as the said upper body is levered about the lower body, the relative aperture between the said slot and edge of the said tongue changes sufficiently to grip and pull a belt passing from between a cylindrical roller and the surface of the said lower body.

3. A buckle as in claim 1 whereby an L-sectioned cam with a limited movement locates laterally in non-circular holes in the sides of the lower body, said cam having a pivoting action that brings its lower edge into contact with a belt passed below it, said cam having an upper edge that can be manually depressed to counter locking movement of lower edge of same cam.

4. A buckle as in claim 1 whereby the pivot end of the upper body is shaped to avoid interfering with the belt permanently affixed to the lower body when the buckle is fully levered open, said upper body is further shaped to facilitate gripping and levering by being upturned at opposing end and shaped to overlap said lower body and prevent access to operating the cam when the buckle is closed.

* * * * *